US006086217A

United States Patent [19]

Jau

[11] Patent Number: 6,086,217

[45] Date of Patent: Jul. 11, 2000

[54] TOOL WITH A LIGHT RECEIVED THEREIN

[75] Inventor: Yu-Jie Jau, Taichung Hsien, Taiwan

[73] Assignees: Paul L. Lee, Cerritos, Calif.; Hsin-Yen Lin, Taichung Hsien, Taiwan; Michael C. Wu, West Covina, Calif.

[21] Appl. No.: 09/247,921

[22] Filed: Feb. 11, 1999

[51] Int. Cl.[7] ..... B25B 23/18

[52] U.S. Cl. ..... 362/119; 362/109; 362/236; 362/120; 362/205; 362/206

[58] Field of Search ..... 362/109, 119, 362/236, 184, 197, 202, 205, 206, 120

[56] References Cited

U.S. PATENT DOCUMENTS 5,772,308 6/1998 Lin ..... 362/119

6,022,121 2/2000 Lin ..... 362/119

*Primary Examiner*—Sandra O'Shea
*Assistant Examiner*—Ismael Negron
*Attorney, Agent, or Firm*—Bacon & Thomas, Pllc

[57] ABSTRACT

A tool includes a handle in which a cassette is received and a shank extending from the handle with a bit or a socket connected to the shank. The cassette has batteries received therein and two tubes extending from the first end thereof so that two bulbs are received in the two tubes. A button device is connected to the second end of the cassette and contacts the batteries. The button device and the cassette are a one-piece member which is conveniently received in and removed from the handle.

10 Claims, 5 Drawing Sheets

TOOL WITH A LIGHT RECEIVED THEREIN

FIELD OF THE INVENTION

The present invention relates to a tool, and more particularly, to a screwdriver having a light means received therein which is powered by batteries engaged in a cassette removably received in the handle of the tool.

BACKGROUND OF THF INVENTION

A conventional screwdriver having a lamp received therein is disclosed in U.S. Pat. No. 5,772,308 to Lin, which is issued on Jun. 30, 1998 and has the title of "Lamp Circuit Assembly Of A Screwdriver". In the screwdrivers disclosed and mentioned in the referenced patent of U.S. Pat. No. 5,772,308, as shown in FIG. 5, two lamps 220 are connected to the conductive plate 222 by two respective lines 221, and the assembly of the conductive plate 222 and the lamps 220 are then riveted to the positioning board 24 so that when the assembly is received in the handle 10 of the tool, the conductive plate 222 is located at the position to properly contact the batteries 200. The manufacturers have to prepare machines to proceed the riveting process of the conductive plate 222 and the positioning board 24 so that a higher manufacturing cost is incurred. Furthermore, the cap 26, the button assembly 25, the batteries 200, the assembly of the lights 200 and the positioning board 24 are separated with each other so that the users or the assemblers will take time to receive them in or remove them from the handle 10. During the removing and receiving actions, some of the parts could drop and the contact between the batteries 200 and the conductive plate 222 could change because the deformation of the conductive plate 222 or other unexpected situations.

The present invention intends to provide a screwdriver having a cassette which is securely and removably received in the handle of the tool and the batteries, the assembly of the lights are well positioned in the cassette so that it is convenient for the users or the manufacturers to insert the cassette or remove the cassette from the handle of the tool. The conductive plate is attached to the inside of the cassette so that the batteries can easily contact the conductive plate in the cassette.

SUMMARY OF THE INVENTION

In accordance with one aspect of the present invention, there is provided a tool comprising a handle having an end portion on the first end thereof and the end portion having a central recess and two passages defined therein. A cassette is removably received in the handle and has two tubes extending from the first end thereof, the tubes are inserted into the two passages and two bulbs are received therein. Each of the bulbs are connected with two conductive wires which extend from a conductive plate attached to the inside of the cassette. A button means is connected to the second end of the cassette and an end cap is connected to the button means to close the second end of the handle.

An object of the present invention is to provide a tool having a cassette which is conveniently received in the handle of the tool, wherein the bulbs, the batteries and the button means are connected to the cassette into a one-piece member.

Further features of the present invention will become apparent after a careful reading of the detailed description with appropriate reference to the accompanying drawings.

DETAILED DESCRIPTION OF THE PREFERRED EMBODIMENTS

Figure 1:
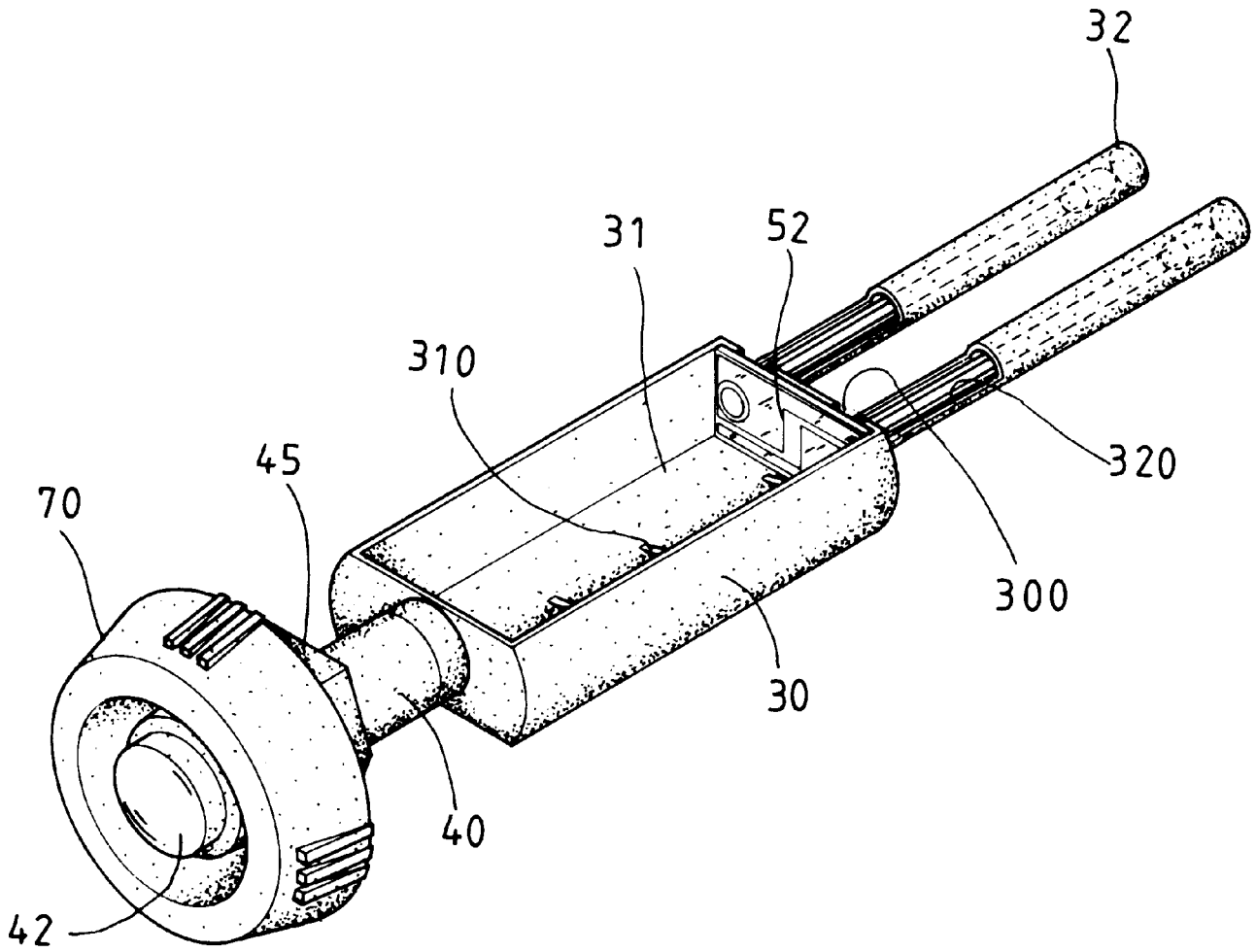
FIG. 1 is a perspective view of the combination of the cassette and the button means in accordance with the present invention.
Figure 2:
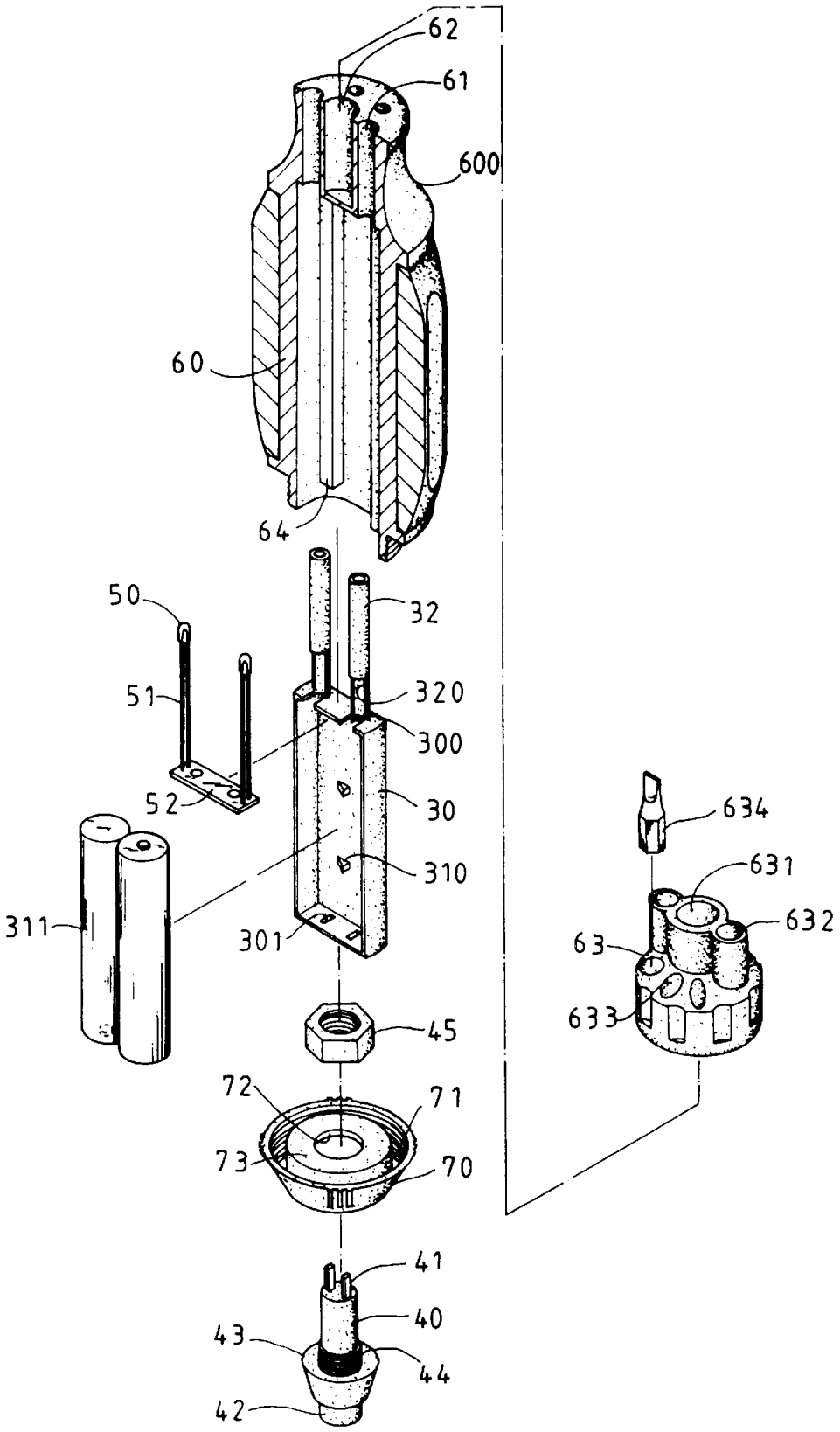
FIG. 2 is an exploded view of the tool in accordance with the present invention.
Figure 3:
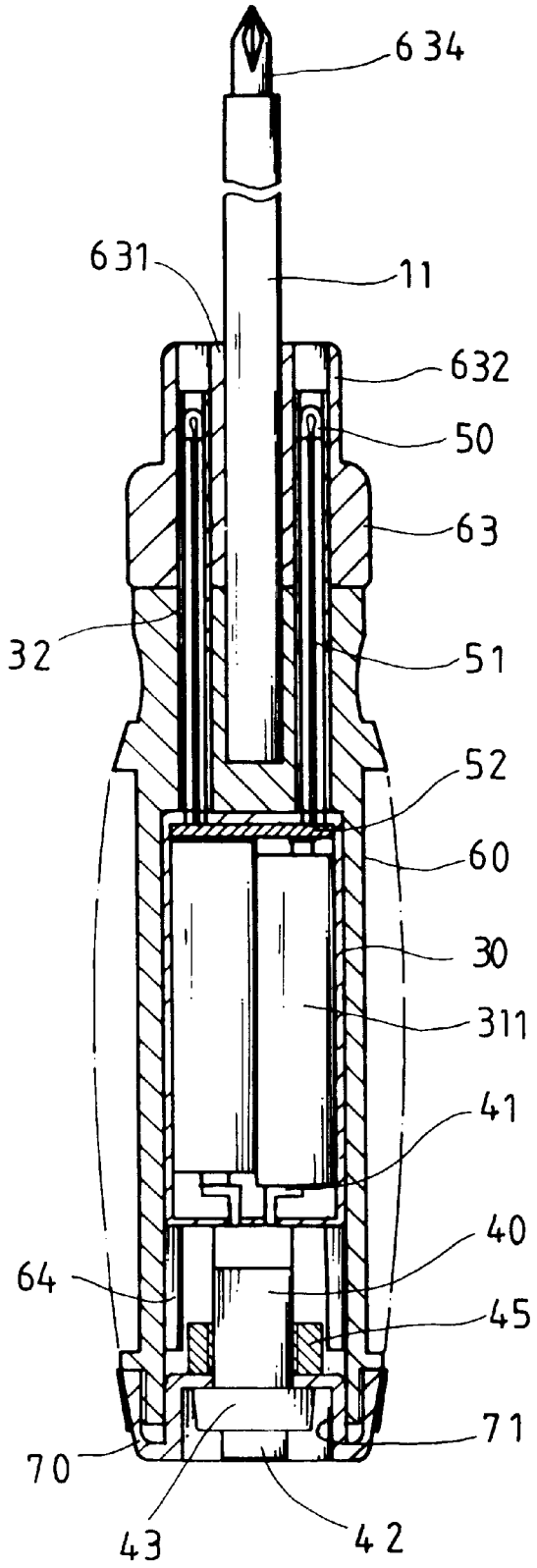
FIG. 3 is a side elevational view, partly in section, of the tool in accordance with the present invention.

Referring to FIGS. 1 to 3, the tool in accordance with the present invention comprises a handle 60 having an end portion 600 connected to the first end thereof, the end portion 600 having a central recess 62 and two passages 61 defined therein. A attachment 63 is mounted to the end portion 600 and has a main tube 631 and two sub-tubes 632, the main tube 631 communicating with the central recess 62 and the sub-tubes 632 communicating with the two passages 61. The attachment 63 further has a plurality of concavities 633 defined therein so as to receive bits 634 therein (see FIG. 4). A cassette 30 is removably received in the handle 60 and has two tubes 32 extending from the first end thereof. Each of the two tubes 32 has a cutouts 320 defined through the wall thereof and extends through the corresponding passage 61. The first end of the cassette 30 has two recesses 300 defined therein which communicate with the two cutouts 320 so that when the two conductive wires 51 and the bulbs 50 (FIG. 1) are inserted into the tubes 32, the wires 51 can easily touched and arranged via the cutouts 320 and the recesses 300. The two conductive wires 51 extend from a conductive plate 52 which is attached to the inside of the first end of the cassette 30. The cassette 30 has two slots 301 defined through the second end thereof and three protrusions 310 extend from the inside of the bottom thereof so as to securely position two batteries 311 in the cassette 30.

A button means 40 is connected to the second end of the cassette 30 and has two contact tips 41 which extend through the two slots 301 so as to contact the batteries 311. The button means 40 has a flange 43 extending radially outward therefrom and a button 42 extends from the button means 40 and located opposite to the two tips 41. A threaded portion 44 is defined in the periphery of the button means 40. An end cap 70 has an inner tube 71 extending from the inside thereof and an end flange 73 extending radially inward from the distal end of the inner tube 71 with a hole 72 defined through the end flange 73. The button means 40 extends through the hole 72 of the inner tube 71 and the flange 43 is engaged with the inside of the end flange 73. A nut 45 is threadedly engaged with the threaded portion 44 to prevent the button means 40 from disengaging from the end cap 70 which closes the second end of the handle 60. The end cap 70 is rotatably connected to the button means 40 and threadedly connected to the second end of the handle 60.

Figure 4:
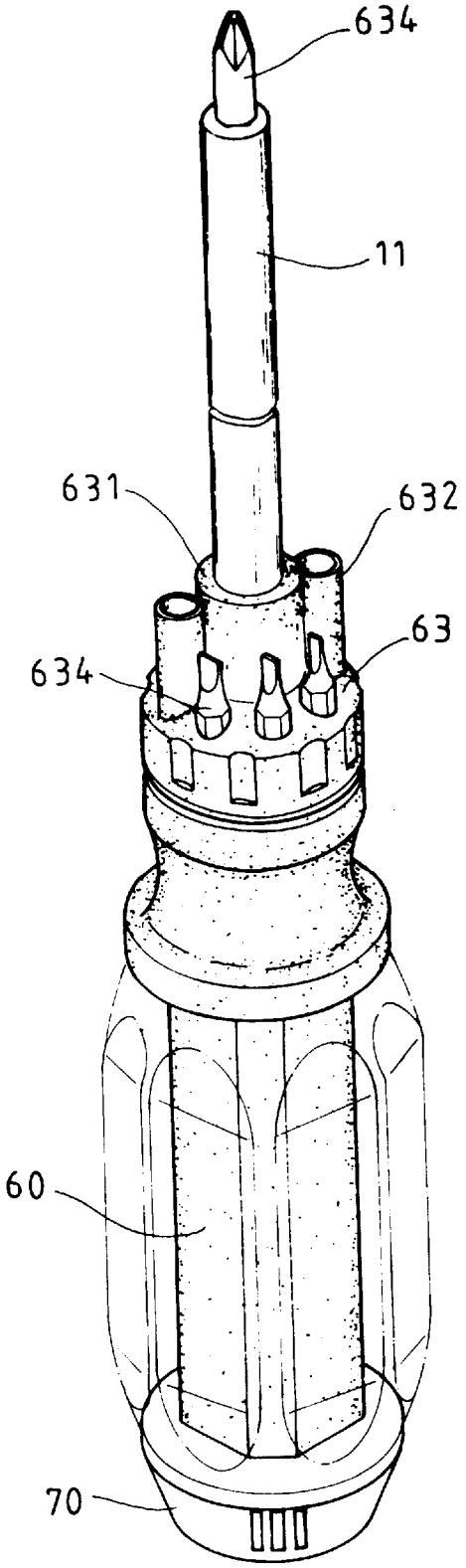
FIG. 4 is a perspective view to show the tool of the present invention with bits attached to the attachment of the tool.
Figure 5:
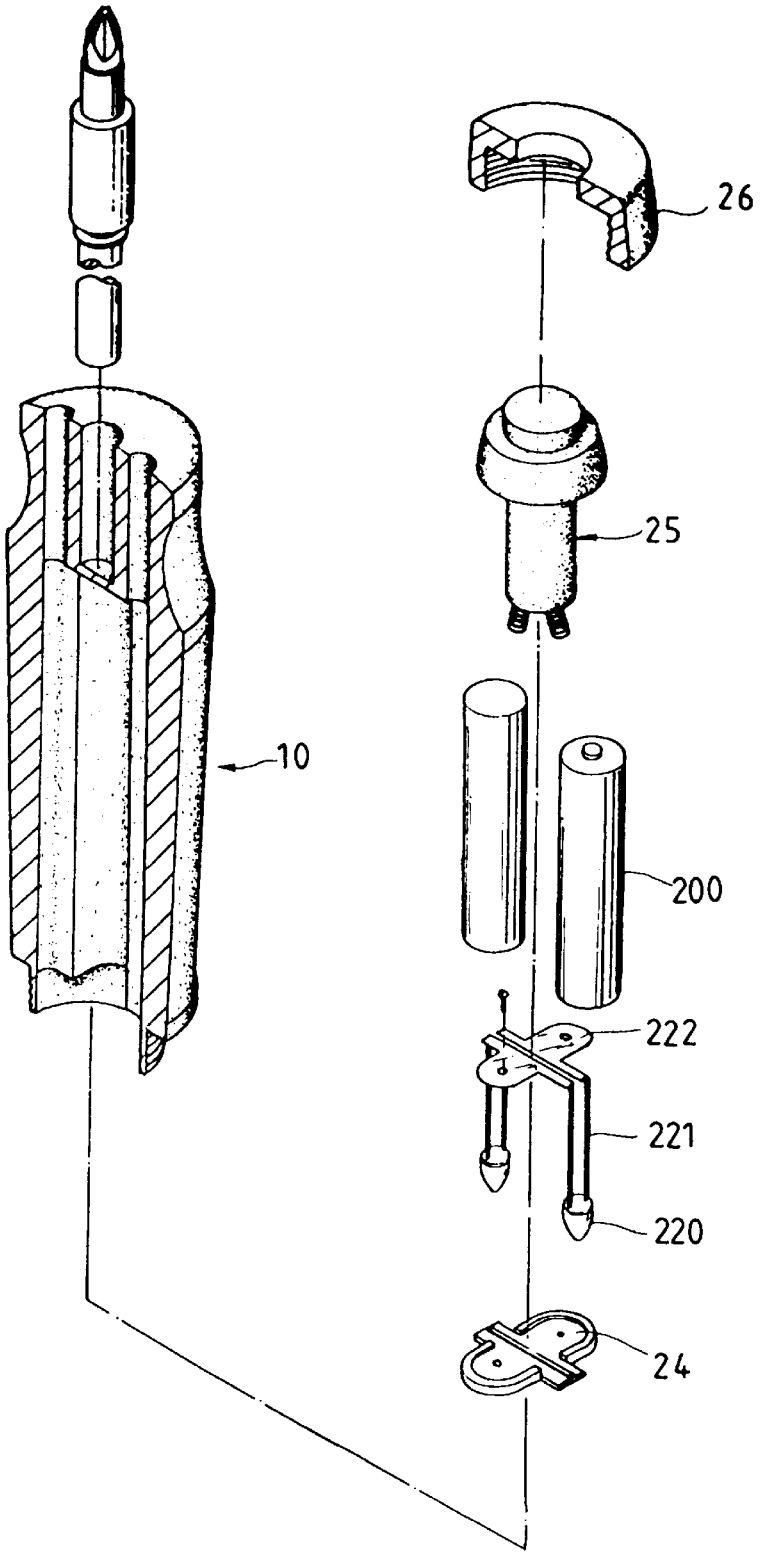
FIG.5 PRIOR ART
FIG. 5 is an exploded view of the conventional tool.

The handle 60 has two rails 64 extending from the inside thereof so that the cassette 30 is conveniently received between the two rails 64. As shown in FIGS. 3 and 4, a shank 11 is fixedly received in the central recess 62 and extends through the main tube 631 so as to connect a bit 634 to its distal end thereof. When pushing the button 42, the two bulbs 50 light up and provide light for the user from the two sub-tubes 632. The shank 11 can be connected to different bits 634 to perform different functions.

The cassette 30 is easily removed from the handle 60 by unthreading the end cap 70 so that the users or the assemblers conveniently to assemble the tool of the present invention.

It is to be understood that the above description and drawings are only used for illustrating some embodiments of the present invention, not intended to limit the scope thereof. Any variation and derivation from the above description and drawings should be included in the scope of the present invention.

What is claimed is:

1. A tool comprising:

a handle having an end portion connected to a first end thereof and said end portion having a central recess and two passages defined therein;

a cassette removably received in said handle and having two tubes extending from the first end thereof, said two tubes extending through said two passages, a button means connected to the second end of said cassette and an end cap connected to said button means so as to close a second end of said handle;

a conductive plate having two pair of conductive wires extending therefrom and two bulbs respectively connected to said two pairs of conductive wires, said conductive plate attached to the inside of the first end of said cassette and said conductive wires together with the two bulbs inserted through said two tubes; and said cassette, bulbs and button means being connected into a one-piece member.

2. The tool as claimed in claim 1, wherein said cassette has three protrusions extending from the inside of the bottom thereof.

3. The tool as claimed in claim 1, wherein said button means has a threaded portion defined in the periphery thereof, a nut threadedly engaged with said threaded portion.

4. The tool as claimed in claim 1, wherein said handle has two rails extending from the inside thereof so that said cassette is received between said two rails.

5. The tool as claimed in claim 1, wherein each of said two tubes has a cutouts defined through the wall thereof.

6. The tool as claimed in claim 5, wherein the first end of said cassette has two recesses defined therein which communicate with said two cutouts.

7. The tool as claimed in claim 1, wherein said cassette has two slots defined through the second end thereof and said button means has two contact tips which extend through said two slots.

8. The tool as claimed in claim 7, wherein said end cap has an inner tube extending from the inside thereof and an end flange extending radially inward from the distal end of said inner tube, a hole defined through said end flange, said button means having a flange extending radially outward therefrom and a button extending from the button means and located opposite to said two tips, said button means extending through said hole of said inner tube and said flange engaged with the inside of said end flange.

9. The tool as claimed in claim 1 further comprising an attachment mounted to said end portion of said handle, said attachment having a main tube and two sub-tubes, said main tube communicating with said central recess and said sub-tubes communicating with said two passages.

10. The tool as claimed in claim 9, wherein said attachment has a plurality of concavities defined therein.

* * * * *